United States Patent [19]

DeMars

[11] Patent Number: 4,602,723

[45] Date of Patent: Jul. 29, 1986

[54] HANDLE FOR BEVERAGE CAN

[76] Inventor: Robert A. DeMars, 7932 Maestro, Canoga Park, Calif. 91304

[21] Appl. No.: 791,736

[22] Filed: Oct. 28, 1985

[51] Int. Cl.[4] ..... A47J 45/00

[52] U.S. Cl. ..... 220/85 H; 220/94 R; 294/27.1

[58] Field of Search ..... 220/85 H, 94 R, 96; 294/27 H

[56] References Cited

U.S. PATENT DOCUMENTS

| | | | |
|---|---|---|---|
| 2,665,936 | 1/1954 | Moore | 220/94 R |
| 2,896,812 | 7/1959 | Paprocki | 220/85 H |
| 3,261,635 | 7/1966 | Talay | 220/85 H |
| 3,269,586 | 8/1966 | Quimby et al. | 220/94 R |
| 4,433,864 | 2/1984 | Byrd | 220/85 H X |

*Primary Examiner*—Steven M. Pollard

*Attorney, Agent, or Firm*—Cislo, O'Reilly & Thomas

[57] ABSTRACT

A handle for releasable attachment to a beverage can having a pull-tab is provided. The handle comprises an expansible, approximately C-shaped holder of resilient material having an upper portion, a downwardly depending shank portion and a lower portion. The upper portion includes a recess for receiving a free end of the pull-tab and a notch for gripping the edge of the top of the beverage can. A lower portion includes a notch for gripping an edge of the bottom of the beverage can.

7 Claims, 3 Drawing Figures

Fig. 1.
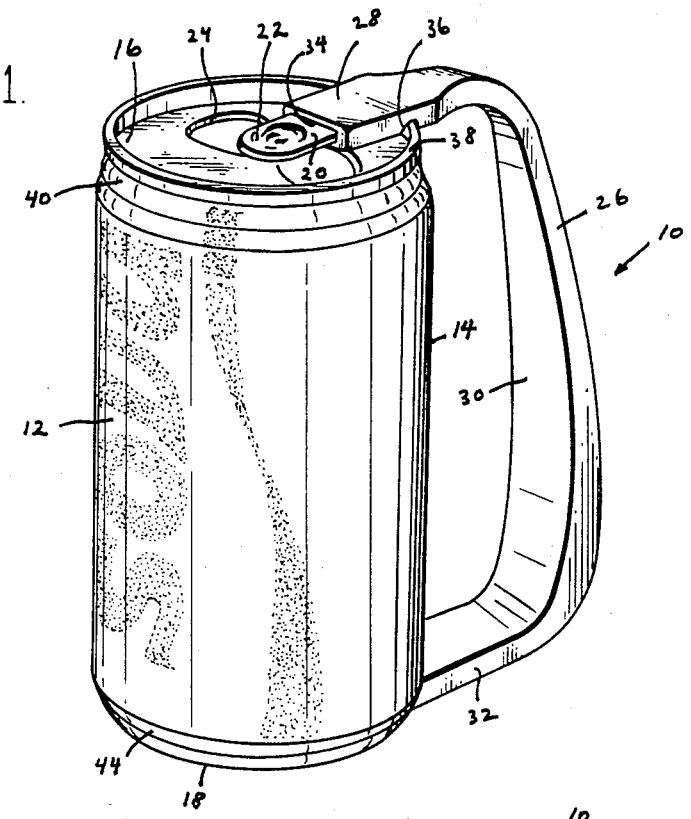
Fig. 2.
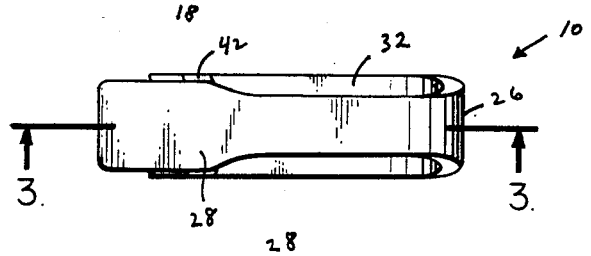
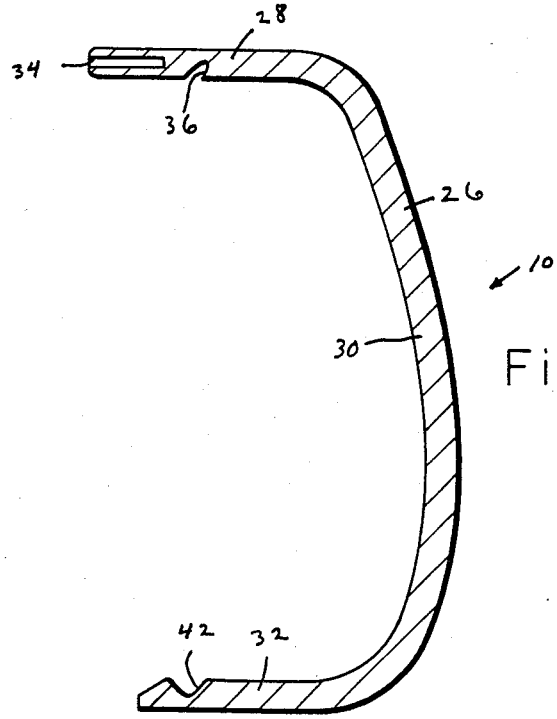
Fig. 3.

HANDLE FOR BEVERAGE CAN

BACKGROUND OF THE INVENTION

This invention relates to a releasably attachable handle for a beverage can.

While beverage cans with their pull-tabs for a convenient way of opening has proven a boon to the beverage industry, such beverage cans are not always convenient for the drinker of the beverage to use. Because the can is metal, it transfers heat or cold readily. Thus, a beverage can that has been chilled will feel cold to the hand and, in fact, if the beverage can has been lying in ice, may feel painfully cold to the hand. Also, the heat of the hand will warm up the beverage in the can faster than the drinker might desire.

Further, it is sometimes difficult to lift the pull-tab to open the beverage can. This is especially true for people with arthritis or long fingernails or the like.

Accordingly, there remains a need to avoid unduly chilling the hand of the user and at the same time prevent unwanted heating of the beverage while holding a beverage can. There also remains a need to assist in lifting the pull-tab to open the beverage can.

OBJECTS AND SUMMARY OF THE INVENTION

Accordingly, it is an object of the present invention to provide a means for enabling a user of a beverage can to avoid direct contact with the beverage can during use thereof.

It is another object of the present invention to provide a handle which is readily attached and detached from the can.

It is still another object of the present invention to provide a handle for attachment to a beverage can which, while readily releasable, is stable during use.

It is yet another object of the present invention to provide a means for lifting the pull-tab of the beverage can.

These and further objects of the invention will become more readily apparent upon a consideration of the following commentary taken in conjunction with the appended drawing.

Briefly, the handle of the invention for releasable attachment to beverage cans having a pull-tab comprises an expansible, approximately C-shaped holder of resilient material having a upper portion, a downwardly depending shank portion and a lower portion, the upper portion including means for receiving a free end of the pull-tab and means for gripping an edge of the top of the beverage can, and the lower portion including means for gripping an edge of the bottom of the beverage can.

BRIEF DESCRIPTION OF THE DRAWING

FIG. 1 is a perspective view of the beverage can handle of the invention, showing attachment to a beverage can;

FIG. 2 is a top plan view of the handle of the invention; and

FIG. 3 is a cross-sectional view taken along the line 3—3 of FIG. 2.

DETAILED DESCRIPTION OF THE PREFERRED EMBODIMENTS

Referring now to the drawing wherein like numerals of reference refer to like elements throughout, a handle for a beverage can is generally depicted at 10.

The beverage can 12 is of the common cylindrical shape, with a sidewall 14 and having parallel disposed top seal 16 and bottom seal 18, as is customary. The beverage can 12 preferably has a pull-tab 20 comprising a lifting portion 22, a scored portion (not shown) in the top seal 16 and a hinge portion (not shown) therebetween, such that pulling up on the lifting portion 22 causes the scored portion to break away from the top seal 16, into the interior of the beverage can 12, while secured to the top seal 16 by a flap, to form an opening 24, from which the beverage may be drunk. Such pull-tabs 20 are well-known and do not form a part of this invention.

The handle 10 comprises an expansible, approximately C-shaped holder 26 having a upper portion 28, a downwardly depending shank portion 30 and a lower portion 32. The downwardly depending shank portion 30 is outwardly spaced from the upper portion 28 and lower portion 32 and is generally arcuate in overall 1 configuration so as to form a hand-graspable surface, or handle, spaced away from sidewall 14 of the beverage can 12.

The upper portion 28 includes a recess means 34 which receives a free end, or lifting portion 22, of the pull-tab 20, used for opening the beverage can 12. The upper portion 28 further includes means 36 for gripping an edge 38 of the top portion 40 of the beverage can 12. Advantageously, the gripping means 36 comprises a notch shaped to the approximate shape of the top edge 38.

The lower portion 32 of the holder 26 includes means 42 for gripping an edge (not shown) of the bottom portion 44 of the beverage can 12. Advantageously, the gripping means 32 comprises a notch shaped to the approximate shape of the bottom edge.

The holder 26 is preferably of unitary construction for ease of fabrication and economy of costs, and comprises an appropriate resilient material, such as a plastic or a metal. The material comprising the holder 26 must be sufficiently rigid to support a full beverage can, yet be sufficiently flexible to permit attachment and detachment of the upper portion 40 and lower portion 44 so as to grip the respective edges of the beverage can 12. Preferably, the holder 26 comprises a plastic material, so as to minimize heat transfer between the user's hand and the beverage can.

In operation, the pull-tab 20 is used to open the beverage can 12 as is customary, and the free end, or lifting portion 22, is rotated approximately 90 degrees to permit ease of drinking the beverage. The free end 22 is inserted into the recess 34 of the holder 26. The upper portion 28 of the holder 26 is fitted so that the edge 38 of the beverage can 12 fits into the gripping means 36 of the upper portion 28 of the holder 26. The holder 26 is then slightly flexed sufficient to permit attachment of the lower portion 32 of the holder 26 so as to engage the bottom edge of the beverage can 12 into the gripping means 42 of the lower portion 32. Detachment from the beverage can 12 is simply the reverse of the foregoing process.

While the handle 10 of the invention may be used as described above, the presence of the recess 34, which engages the free end 22 of the pull-tab 20, may also be used to assist in opening the beverage can 12 prior to attachment of the handle 10 to the beverage can 12. In this case, the free end 22 of the pull-tab 20 is engaged in the recess 34, the pull-tab 20 is activated by lifting up on the holder 26 sufficient to depress the scored portion of the pull-tab 20 into the interior of the beverage, and the holder 26 is rotated approximately 90 degrees and is attached to the beverage can 12 as described above.

While the handle 10 has been described for use in connection with a beverage can 12 having a pull-tab 20 with a lifting portion 22, it will be appreciated that the handle of the invention may be employed with other beverage cans of like dimensions, but having other means of opening, such as the "pop-top" configuration, and others.

Thus, there has been disclosed a handle for a beverage can for engagement with the top and bottom edges of the beverage can. Various changes and modifications of an obvious nature will make themselves available to those of ordinary skill in the art, and all such changes and modifications are considered to be within the scope of the appended claims.

What is claimed is:

1. A handle for releasable attachment to a beverage can having a pull-tab comprising an expansible, approximately C-shaped holder of resilient material having an upper portion, a downwardly depending shank portion and a lower portion, said upper portion including means for receiving a free end of said pull-tab and means for gripping an edge of the top of said beverage can and said lower portion including means for gripping an edge of the bottom of said beverage can.

2. The handle as defined in claim 1, wherein said means for gripping an edge of said top of said beverage can comprises a notch formed in said upper portion of said holder.

3. The handle as defined in claim 1, wherein said means for gripping an edge of said bottom of said beverage can comprises a notch formed in said lower portion of said holder.

4. The handle as defined in claim 1, wherein said holder comprises a resilient material selected from the group consisting of plastics and metals.

5. The handle as defined in claim 1, wherein said means for receiving a free end of said pull-tab comprises a recess portion formed in said upper portion.

6. The handle as defined in claim 1, wherein said downwardly depending shank portion is outwardly spaced from said upper and said lower portions and is generally arcuate in overall configuration so as to form said handle, spaced away from the sidewall of said beverage can.

7. The handle as defined in claim 1, wherein said handle is of one piece, integral construction.

* * * * *